US009296973B2

(12) United States Patent
Fu et al.

(10) Patent No.: US 9,296,973 B2
(45) Date of Patent: Mar. 29, 2016

(54) LUBRICATING OIL COMPOSITION FOR USE IN ALL TRANSMISSION SYSTEMS

(75) Inventors: Xisheng Fu, Beijing (CN); Liping Mi, Beijing (CN); Jing Xu, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 93 days.

(21) Appl. No.: 14/116,083

(22) PCT Filed: May 4, 2012

(86) PCT No.: PCT/CN2012/000599

§ 371 (c)(1), (2), (4) Date: Feb. 18, 2014

(87) PCT Pub. No.: WO2012/152059

PCT Pub. Date: Nov. 15, 2012

(65) Prior Publication Data

US 2014/0162919 A1 Jun. 12, 2014

(30) Foreign Application Priority Data

May 6, 2011 (CN) ..... 2011 1 0117077

(51) Int. Cl.

| | |
|---|---|
| ***C10M 133/56*** | (2006.01) |
| ***C10M 135/12*** | (2006.01) |
| ***C10M 137/16*** | (2006.01) |
| ***C10M 143/06*** | (2006.01) |
| ***C10M 141/10*** | (2006.01) |
| ***C10M 141/08*** | (2006.01) |
| ***C10M 163/00*** | (2006.01) |

(52) U.S. Cl.

CPC ..... *C10M 141/10* (2013.01); *C10M 141/08* (2013.01); *C10M 163/00* (2013.01); *C10M 2203/1006* (2013.01); *C10M 2203/1025* (2013.01); *C10M 2205/026* (2013.01); *C10M 2205/0285* (2013.01); *C10M 2207/126* (2013.01); *C10M 2207/281* (2013.01); *C10M 2207/2825* (2013.01); *C10M 2207/2835* (2013.01); *C10M 2209/084* (2013.01); *C10M 2215/28* (2013.01); *C10M 2219/022* (2013.01); *C10M 2219/044* (2013.01); *C10M 2219/046* (2013.01); *C10M 2219/08* (2013.01); *C10M 2219/088* (2013.01); *C10M 2219/089* (2013.01); *C10M 2219/106* (2013.01); *C10M 2221/041* (2013.01); *C10M 2223/04* (2013.01); *C10M 2223/043* (2013.01); *C10M 2223/045* (2013.01); *C10M 2223/047* (2013.01); *C10M 2223/049* (2013.01); *C10M 2223/06* (2013.01); *C10M 2223/063* (2013.01); *C10N 2230/02* (2013.01); *C10N 2230/06* (2013.01); *C10N 2230/10* (2013.01); *C10N 2230/12* (2013.01); *C10N 2230/42* (2013.01); *C10N 2230/43* (2013.01); *C10N 2230/44* (2013.01); *C10N 2230/45* (2013.01); *C10N 2240/04* (2013.01); *C10N 2240/042* (2013.01)

(58) Field of Classification Search

CPC ..... C10M 2215/28; C10M 2207/281; C10M 141/10; C10M 163/00; C10M 141/08; C10M 2207/2825; C10M 2203/1006; C10M 2219/106; C10M 2203/1025; C10M 2205/0285; C10M 2207/2835; C10M 2219/044; C10M 2219/046; C10M 2221/041; C10M 2219/089; C10M 2223/04; C10M 2223/043; C10M 2223/049; C10M 2209/084; C10N 2260/12; C10N 2260/14; C10N 2230/42; C10N 2230/43; C10N 2230/10; C10N 2230/44; C10N 2230/02; C10N 2230/12; C10N 2240/04; C10N 2240/042

USPC ..... 508/192, 228, 229, 291, 316, 272, 436, 508/390, 391, 392, 393, 408, 586, 287, 280, 508/279, 273, 574

See application file for complete search history.

(56) References Cited

U.S. PATENT DOCUMENTS

| | | | | |
|---|---|---|---|---|
| 3,865,740 | A * | 2/1975 | Goldschmidt | 508/289 |
| 5,824,626 | A * | 10/1998 | Sowerby | 508/300 |
| 2002/0142922 | A1 * | 10/2002 | Yagishita et al. | 508/374 |
| 2005/0113265 | A1 * | 5/2005 | Yagishita | 508/188 |
| 2006/0025314 | A1 * | 2/2006 | Henly | 508/273 |
| 2006/0276352 | A1 * | 12/2006 | Vinci | 508/272 |
| 2009/0093384 | A1 * | 4/2009 | Ward et al. | 508/205 |
| 2009/0275491 | A1 * | 11/2009 | Komatsubara et al. | 508/192 |
| 2010/0105585 | A1 | 4/2010 | Carey et al. | |

FOREIGN PATENT DOCUMENTS

| | | | |
|---|---|---|---|
| CN | 1028244 | C | 4/1995 |
| CN | 1209449 | C | 7/2005 |
| CN | 100497562 | C | 6/2009 |
| GB | 673955 | * | 3/1949 |

* cited by examiner

*Primary Examiner* — Pamela H Weiss

(57) ABSTRACT

Provided is a lubricant composition for a full transmission system, comprising: (A) at least an ashless dispersant; (B) at least a friction modifier; (C) at least a phosphorus-containing antiwear agent; (D) at least an antirust additive; (E) at least a sulfur-containing extreme-pressure additive; (F) at least a metal deactivation additive; (G) at least a viscosity index improver; (H) at least a pour-point depressant; and (I) at least a highly refined mineral oil with high viscosity index, or polyolefin synthetic oil, or ester synthetic oil, or any combination of the above components. The lubricant composition has excellent cleaning dispersity, frictional characteristic, antirust and anti-corrosive properties and extreme pressure abrasion resistance, meets US force standard MIL-PRF-2105E, and can be used for lubrication in various vehicle transmission systems.

10 Claims, No Drawings

LUBRICATING OIL COMPOSITION FOR USE IN ALL TRANSMISSION SYSTEMS

FIELD OF INVENTION

The present invention relates to a lubricant composition, and in particular, to a multi-purpose lubricant composition for a vehicle transmission system, within a technical field of lubricant and lubricant additive.

RELATED ART

The vehicle transmission system primarily includes a manual speed control system and an actuating system; generally, special lubricants are required for lubrication in the manual speed control system and the actuating system, wherein lubrication in the manual gear box with MTF, and lubrication in the actuating system with vehicle gear oil meeting API GL-5 or API GL-4.

Each of the large-scale automobile manufacturers has established its own standard for oil for the manual gear box of the passenger cars, in summary, all being required to pass the synchronizer manual gear box cyclic bench test SSP-180; the oil for the manual gear box of the commercial cars is required to pass the cyclic bench test MACK, with the highest standard thereof is API MT-1; and the oil for live axle is required to pass four bench tests, i.e., CRC L-42, L-37, L-60, L-33, with the highest standard thereof is API GL-5. The oil for the manual gear box is highlighted in thermal oxidation stability, anti-corrosiveness, frictional behavior and anti-wear endurance, while the oil for the live axle is highlighted in extreme pressure abrasion resistance, loadability and scratch resistance. Due to incompatibility between extreme pressure and anti-corrosiveness, extreme pressure and thermal oxidation stability, antiwear and frictional behavior, it is difficult for the oil for the manual gear box and the oil for the live axle to enable generalization. In the US force standard MIL-PRF-2105E, provided was the standard for generalization of the oil for the manual gear box and the oil for the live axle, but the oil products meeting the MIL-PRF-2105E standard have not been reported in detail and published for its composition in literature and patents at home and abroad. The lubricant composition for full transmission system provided by the present invention fully meets the US force standard MIL-PRF-2105E, leading to generalization of the oils for the vehicle transmission system.

SUMMARY OF THE INVENTION

An object of the present invention is to provide a lubricant composition for a full transmission system, having excellent high and low temperature performance, extreme pressure abrasion resistance, scratch resistance, loadability, frictional behavior, antirust and anticorrosive properties, thermo-oxidative stability, anti-wear endurance, anti-foaming property and seal compatibility, fully meeting the US force standard MIL-PRF-2105E, and enabling all weather lubrication in all of vehicle transmission systems, leading to generalization of the oils for the full transmission system.

For the purposes above, with careful selection of the basic oil components and additive components in the lubricant composition, with overall study on the oils as the components, the function additive for each component, the interaction between the base oil and the additive, with highlighting the high and low temperature performance, extreme pressure abrasion resistance, scratch resistance, loadability, frictional behavior, antirust and anticorrosive properties, thermo-oxidative stability, anti-wear endurance, anti-foaming property and seal compatibility, the incompatibility between extreme pressure and corrosion, extreme pressure and thermal oxidation stability, anti-wear and frictional behavior is overcome to enable lubrication of the lubricant composition of the present invention in both the manual gear box and the actuating system of vehicle, leading to generalization of the oils for the transmission system.

The lubricant composition for the full transmission system formulated in the present invention has excellent energy-saving and antifriction performance, high and low temperature performance, extreme pressure abrasion resistance, scratch resistance, loadability, frictional behavior, antirust and anticorrosive properties, thermo-oxidative stability, anti-wear endurance, anti-foaming property and seal compatibility, meets the requirements for SAE75W, 75W/80, 75W/85, 75W/90, 80W, 80W/85, 80W/90, 80W/140 viscosity levels, passes the CRC L-42, L-37, L-33, L-60, L-60-1 full size gear bench test, the manual gear box MACK cyclic bench test for truck and autobus and the manual gear box SSP-180 synchronization endurance cyclic bench test for car, fully meets the US force standard MIL-PRF-2105E while enabling lubrication in the manual gear box and live axle of vehicle, leading to generalization of the oils for the vehicle transmission system. The product has a broad application area, and enables lubrication in the transmission system of various vehicles, solving all the problems on lubrication in the vehicle transmission system and having well economic and social benefits. The lubricant composition is convenient in formulation, superior in performance and has attractive outlook of generalization.

The lubricant composition for the full transmission system comprises: (A) at least an ashless dispersant; (B) at least a friction modifier; (C) at least a phosphorus-containing anti-wear agent; (D) at least an antirust additive; (E) at least a sulfur-containing extreme-pressure additive; (F) at least a metal deactivation additive; (G) at least a viscosity index improver; (H) at least a pour-point depressant; and (I) at least a highly refined mineral oil with high viscosity index, or polyolefin synthetic oil, or ester synthetic oil, or any combination of the above components. The (A) is mono(polyisobutenyl) succinimide, or bis(polyisobutenyl) succinimide, or multi(polyisobutenyl) succinimide, or boronated mono (polyisobutenyl) succinimide, or boronated bis(polyisobutenyl) succinimide, or boronated multi(polyisobutenyl) succinimide, or borophosphorated mono(polyisobutenyl) succinimide, or borophosphorated bis(polyisobutenyl) succinimide, or borophosphorated multi(polyisobutenyl) succinimide, or mixture from any combination thereof, and is contained in the lubricant composition at 0.5-5.0 wt %; the (B) is long-chain phosphate, or long-chain phosphite, or long-chain phosphonate, or long-chain fatty acid ester, or long-chain boronated fatty acid ester, or long-chain phosphate amine salt, or long-chain phosphite amine salt, or long-chain phosphonate amine salt, or mixture from any combination thereof, and is contained in the lubricant composition at 0.1-2.0 wt %; the (C) is thiophosphoric acid fatty amine formaldehyde condensate, or thiophosphoric acid benzotriazole formaldehyde condensate, or thiophosphate and amine salt thereof, or mixture from any combination thereof, and is contained in the lubricant composition at 0.1-2.0 wt %; the (D) is alkyl sulfonate with high base number, or alkyl sulfonate with low base number, or sulfurized alkyl phenate with high base number, or sulfurized alkyl phenate with low base number, or mixture from any combination thereof, and is contained in the lubricant composition at 0.01-1.0 wt %; the (E) is sulfurized olefin, or sulfurized polyolefin, or alkyl polysulfide, or mixture from any combination thereof, and is contained in the lubricant composition at 3.0-6.0 wt %; the (F) is thiadiazole disulfide, or alkylated thiadiazole dimer, or thiadiazole fatty amine formaldehyde condensate, or adduct of thiadiazole and long-chain olefin, or mixture from any combination thereof, and is contained in the lubricant composition at 0.01-1.0 wt %; the (G) is polymethacrylate, or low-molecular-weight polyisobutylene, or mixture from any combination thereof, and is contained in the lubricant composition at 0.1-25 wt %; the (H) is polymethacrylate, or poly(α-olefin), or mixture from any combination thereof, and is contained in the lubricant composition at 0.1-2.0 wt %; and the (I) is the highly refined mineral oil with high viscosity index, or polyolefin synthetic oil, or ester synthetic oil, or mixture from any combination thereof, and is contained in the lubricant composition at 56.00-96.08 wt %.

Further, the lubricant composition for the full transmission system according to the present invention comprises: (A) at least an ashless dispersant; (B) at least a friction modifier; (C) at least a phosphorus-containing antiwear agent; (D) at least an antirust additive; (E) at least a sulfur-containing extreme-pressure additive; (F) at least a metal deactivation additive; (G) at least a viscosity index improver; (H) at least a pour-point depressant; and (I) at least a highly refined mineral oil with high viscosity index, or polyolefin synthetic oil, or ester synthetic oil, or any combination of the above components.

Wherein the component (A) is preferably mono(polyisobutenyl) succinimide, or bis(polyisobutenyl) succinimide, or multi(polyisobutenyl) succinimide, or boronated mono (polyisobutenyl) succinimide, or boronated bis(polyisobutenyl) succinimide, or boronated multi(polyisobutenyl) succinimide, or borophosphorated mono(polyisobutenyl) succinimide, or borophosphorated bis(polyisobutenyl) succinimide, or borophosphorated multi(polyisobutenyl) succinimide, or mixture from any combination thereof, with a molecular weight of polyisobutylene being 500-5000, and is contained in the lubricant composition at an appropriate amount of 1.0-5.0 wt %;

the component (B) is preferably dodecyl phosphate, or octadecyl phosphate, or dodecyl phosphite, or octadecyl phosphite, or dodecyl phosphonate, or octadecyl phosphonate, or ethylene glycol oleate, or glycerol oleate, or boronated ethylene glycol oleate, or boronated glycerol oleate, or phosphate laurylamine salt, or phosphate stearylamine salt, or phosphite laurylamine salt, or phosphite octadecylamine salt, or phosphonate laurylamine salt, or phosphonate octadecylamine salt, or mixture from any combination thereof, and is contained in the lubricant composition at an appropriate amount of 0.2-2.0 wt %;

the component (C) is preferably di-n-butyl thiophosphoric acid fatty amine formaldehyde condensate, or di-n-butyl thiophosphoric acid benzotriazole formaldehyde condensate, or di-n-butyl thiophosphate fatty amine salt, or mixture from any combination thereof, and is contained in the lubricant composition at an appropriate amount of 0.3-2.0 wt %;

the (D) component is preferably calcium alkylbenzene sulfonate with high base number, or calcium alkylbenzene sulfonate with low base number, or calcium sulfurized alkyl phenate with high base number, or calcium sulfurized alkyl phenate with low base number, or mixture from any combination thereof, and is contained in the lubricant composition at an appropriate amount of 0.02-1.0 wt %;

the component (E) is preferably multi-sulfurized polyisobutylene, or multi-sulfurized isobutylene, or tert-butyl polysulfide, or mixture from any combination thereof, and is contained in the lubricant composition at an appropriate amount of 3.0-5.0 wt %;

the component (F) is preferably thiadiazole dodecyl disulfide, or thiadiazole octadecyl disulfide, or dodecyl thiadiazole dimer, or octadecyl thiadiazole dimer, or thiadiazole laurylamine formaldehyde condensate, or thiadiazole stearylamine formaldehyde condensate, or adduct of thiadiazole and dodecylene, or adduct of thiadiazole and octadecene, or mixture from any combination thereof, and is contained in the lubricant composition at an appropriate amount of 0.05-1.0 wt %;

the component (G) is preferably polymethacrylate with a molecular weight of 500-5000, or polyisobutylene with a molecular weight of 800-2000, or mixture from any combination thereof, and is contained in the lubricant composition at an appropriate amount of 0.1-20 wt %;

the component (H) is preferably polymethacrylate, or poly (α-olefin), or mixture from any combination thereof, and is contained in the lubricant composition at an appropriate amount of 0.3-2.0 wt %; and the component (I) is preferably the isomerized, dewaxed and hydrogenated base oil, or poly(α-olefin) synthetic oil, or di-ester synthetic oil, or polyol ester synthetic oil, or mixture from any combination thereof, and is contained in the lubricant composition at an appropriate amount of 62.00-94.93 wt %.

Method for preparing the lubricant composition for the full transmission system: to a stainless steel blending kettle equipped with a stirrer, adding the component oil (I) at a proportional amount; subsequently, adding the viscosity index improver (G) and the pour-point depressant (H) at a proportional amount, heating up to 70-80° C. with stirring for 2 hours, cooling down to 50-60° C.; and then adding the sulfur-containing extreme-pressure additive (E), the phosphor-containing antiwear additive (C), the metal deactivation additive (F), the antirust additive (D), the friction modifier (B) and the ashless dispersant (A), then stirring at 50-60° C. for 4 hours, until the mixture is homogeneous and clear.

DETAILED DESCRIPTION OF THE INVENTION

The present invention will be further described for its effectiveness in the following examples. It shall be understood that, the following examples have no limitation to the scope of the present invention, and any modification without deviation from the conception and scope of the present invention will fall within the scope of the present invention.

EXAMPLE 1

The lubricant composition (I) was comprised of: 5.0 wt % of mono(polyisobutenyl) succinimide (Component A); 1.0 wt % of dodecyl phosphite, 0.5 wt % of boronated ethylene glycol oleate, 0.5 wt % of phosphonate stearylamine salt (Component B); 0.2 wt % di-n-butyl thiophosphoric acid fatty amine formaldehyde condensate, 0.2 wt % of di-n-butyl thiophosphoric acid benzotriazole formaldehyde condensate, 0.5 wt % of di-n-butyl thiophosphate fatty amine salt (Component C); 0.2 wt % of calcium sulfurized alkyl phenate with high base number (Component D); 5.0 wt % of tert-butyl polysulfide (Component E); 0.05 wt % of the adduct of thiadiazole and octadecene (Component F); 7.4 wt % of polymethacrylate (Component G); 1.0 wt % of poly(α-olefin) (Component H); 31.38 wt % of the isomerized, dewaxed and hydrogenated base oil (oil worksite No. 4), 31.38 wt % of poly(α-olefin) synthetic oil PAO-4, 15.69 wt % of di-ester synthetic oil A51 (Component I). The lubricant composition (II) was the same as the composition (I), except that in the component (A), 5.0 wt % of mono(polyisobutenyl) succinimide was replaced by 5.0 wt % of bis(polyisobutenyl) succinimide. The lubricant composition (III) was the same as the composition (I), except that in the component (A), 5.0 wt % of mono(polyisobutenyl) succinimide was replaced by 5.0 wt % of multi(polyisobutenyl) succinimide. The lubricant composition (IV) was the same as the composition (I), except that in the component (A), 5.0 wt % of mono(polyisobutenyl) succinimide was replaced by 5.0 wt % of boronated mono(polyisobutenyl) succinimide. The lubricant composition (V) was the same as the composition (I), except that in the component (A), 5.0 wt % of mono(polyisobutenyl) succinimide was replaced by 5.0 wt % of borophosphorated mono(polyisobutenyl) succinimide. The properties of the composition (I), (II), (III), (IV) and (V) were set forth in table 2.

TABLE 2

Main properties of the compositions

| Item | Composition (I) | Composition (II) | Composition (III) | Composition (IV) | Composition (V) |
|---|---|---|---|---|---|
| MACK cyclic bench Number of cycle | 78000 | 38000 | 23000 | 81000 | 114500 |

It was seen from the table that, the type of the ashless dispersant had a significant effect on cyclic endurance, with mono(polyisobutenyl) succinimide as the ashless dispersant being preferred over bis(polyisobutenyl) succinimide as the ashless dispersant, bis(polyisobutenyl) succinimide as the ashless dispersant being preferred over multi(polyisobutenyl) succinimide as the ashless dispersant, boronated mono(polyisobutenyl) succinimide as the ashless dispersant being preferred over mono(polyisobutenyl) succinimide as the ashless dispersant, and borophosphorated mono(polyisobutenyl) succinimide as the ashless dispersant being preferred over boronated mono(polyisobutenyl) succinimide as the ashless dispersant.

EXAMPLE 2

The lubricant composition (VI) was comprised of: 3.0 wt % of mono(polyisobutenyl) succinimide, 1.5 wt % of bis (polyisobutenyl) succinimide, 0.5 wt % of borophosphorated multi(polyisobutenyl) succinimide (Component A); 2.0 wt % of octadecyl phosphite (Component B); 0.25 wt % di-n-butyl thiophosphoric acid fatty amine formaldehyde condensate, 0.25 wt % of di-n-butyl thiophosphoric acid benzotriazole formaldehyde condensate, 0.50 wt % of di-n-butyl thiophosphate fatty amine salt (Component C); 1.0 wt % of calcium alkylbenzene sulfonate with low base number (Component D); 5.0 wt % of tert-butyl polysulfide (Component E); 0.25 wt % of thiadiazole dodecyl disulfide, 0.25 wt % of dodecyl thiadiazole dimer, 0.25 wt % of thiadiazole laurylamine formaldehyde condensate, 0.25 wt % of the adduct of thiadiazole and dodecylene (Component F); 12.0 wt % of polymethacrylate (Component G); 2.0 wt % of poly(α-olefin) (Component H); and 71.0 wt % of the isomerized, dewaxed and hydrogenated base oil (oil worksite No. 6) (Component I). The lubricant composition (VII) was the same as the composition (VI), except that in the component (B), 2.0 wt % of octadecyl phosphite was replaced by 2.0 wt % of octadecyl phosphate. The lubricant composition (VIII) was the same as the composition (VI), except that in the component (B), 2.0 wt % of octadecyl phosphite was replaced by 2.0 wt % of octadecyl phosphonate. The lubricant composition (IX) was the same as the composition (VI), except that in the component (B), 2.0 wt % of octadecyl phosphite was replaced by 2.0 wt % of phosphite stearylamine salt. The lubricant composition (X) was the same as the composition (VI), except that in the component (B), 2.0 wt % of octadecyl phosphite was replaced by 2.0 wt % of phosphate stearylamine salt. The lubricant composition (XI) was the same as the composition (VI), except that in the component (B), 2.0 wt % of octadecyl phosphite was replaced by 2.0 wt % of phosphonate stearylamine salt. The properties of the composition (VI), (VII), (VIII), (IX), (X) and (XI) were set forth in table 3.

TABLE 3

Main properties of the compositions

| Item | Composition (VI) | Composition (VII) | Composition (VIII) | Composition (IX) | Composition (X) | Composition (XI) |
|---|---|---|---|---|---|---|
| SSP-180 Number of cycle | 100000 | 78000 | 54000 | 100000 | 85000 | 76000 |

It can be concluded from the table that, the type of the friction modifier had a significant effect on cyclic endurance, with phosphite being preferred over phosphate, phosphate being preferred over phosphonate, and introduction of fatty amine being advantageous to cyclic endurance.

EXAMPLE 3

The lubricant composition (XII) was comprised of: 0.5 wt % of mono(polyisobutenyl) succinimide, 2.0 wt % of borophosphorated mono(polyisobutenyl) succinimide (Component A); 0.1 wt % of octadecyl phosphite, 0.1 wt % of boronated glycerol oleate, 0.8 wt % of phosphite stearylamine salt (Component B); 0.2 wt % di-n-butyl thiophosphoric acid fatty amine formaldehyde condensate, 0.2 wt % of di-n-butyl thiophosphoric acid benzotriazole formaldehyde condensate, 0.2 wt % of di-n-butyl thiophosphate fatty amine salt (Component C); 1.0 wt % of calcium alkylbenzene sulfonate with low base number (Component D); 5.0 wt % of tert-butyl polysulfide (Component E); 0.10 wt % of thiadiazole dodecyl disulfide (Component F); 12.0 wt % of polymethacrylate (Component G); 2.0 wt % of poly(α-olefin) (Component H); and 75.8 wt % of the isomerized, dewaxed and hydrogenated base oil (oil worksite No. 6) (Component I).

INDUSTRIAL APPLICABILITY

All of the testing methods used in the laboratory by the present invention, meeting the US force standard MIL-PRF-2105E, were found in table 1.

TABLE 1

Testing method for US force standard MIL-PRF-2105E

| Test name | ASTM testing method |
|---|---|
| Kinematic viscosity | D445 |
| Brookfield viscosity | D2983 |
| Viscosity index | D2270 |
| Channel point | FED-STD-791 3456 |
| Flash point | D92 |
| Specific gravity (API) | D287 |
| Pour point | D97 |
| Pentane insolubles | D893 |
| Carbon residue | D524 |
| Chroma | D1500 |
| Total acid number | D664 |
| Saponification number | D94 |
| Distillation range | D2887 |
| Sulfur content | D1552 |
| Phosphorus content | D1091 |
| Chlorine content | D808 |
| Nitrogen content | D3228, D4629 |
| Metal content | D4628, D4927, D4951, D5185 |
| Anti-foaming property | D892 |
| Storage stability | FED-STD-791 3440 |
| Compatibility | FED-STD-791 3430 |
| Copper corrosion | D130 |
| Humidity corrosion | L-33 |
| Thermo-oxidative stability | L-60-1 |
| Scratch resistance | L-42 |
| Loadability | L-37 |

TABLE 1-continued

| Testing method for US force standard MIL-PRF-2105E | |
|---|---|
| Test name | ASTM testing method |
| Cyclic endurance | D5579 |
| Compatibility with sealing material | D5662 |

The results of analysis and assessment on the lubricant composition (XII) from Example 3 were found in table 4.

TABLE 4

| Results of analysis and assessment on the composition (XII) | | |
|---|---|---|
| Item | Quality indicator | Results of assessment |
| kinematic viscosity, $mm^2/s$, at 100° C. | 11.0-13.5 | 12.32 |
| Brookfield viscosity, mpa.s, at −40° C. | Not more than 150000 | 123600 |
| Viscosity index | Report | 158 |
| Channel point, ° C. | Not more than −45 | Less than −45 |
| Flash point (open), ° C. | Not less than 150 | 218 |
| Pour point, ° C. | Not more than −42 | −46 |
| Pentane insolubles, % | Report | 0.008 |
| Chroma | Report | 0.1 |
| Sulfur content, % | Report | 2.56 |
| Phosphorus content % | Report | 0.14 |
| Chlorine content, % | Report | None |
| Nitrogen content, % | Report | 0.12 |
| Anti-foaming property | | |
| 24° C. | Not more than 20 | 0 |
| 93.5° C. | Not more than 50 | 10 |
| Late 24° C. | Not more than 20 | 0 |
| Storage stability | Storage stability | |
| Liquid precipitate, % (V) | Not more than 0.5 | None |
| Solid precipitate, % (m) | Not more than 0.25 | 0.023 |
| Compatibility | Pass | Pass |
| Copper corrosion (121° C.) | Not higher than 2a | 1b |
| Scratch resistance test (L-42) | Pass | Pass |
| Loadability test (L-37) | Pass | Pass |
| Tarnishing test (L-33) | | |
| Ranking of tarnishing on cover | Not less than 8.0 | 9.56 |
| Tarnishing on gear, tooth face, bearing and other sites | Not more than rustless score | Rustles |
| Thermal oxidation stability (L-60-1) | | |
| Kinematic viscosity growth %, at 100° C. | Not less than 100 | 32.20 |
| Pentane insolubles, % | Not more than 3 | 0.032 |
| Toluene insolubles, % | Not less than 2 | 0.021 |
| Average ranking of varnish/coke on master gear | Not less than 7.5 | 8.75 |
| Average ranking of oil sludge on four sides | Not less than 9.4 | 9.86 |
| Thermal oxidation stability (L-60) | | |
| Kinematic viscosity growth %, at 100° C. | Not less than 100 | 32.20 |
| Pentane insolubles, % | Not more than 3 | 0.032 |
| Toluene insolubles, % | Not more than 2 | 0.021 |
| Compatibility with sealing material | Pass | Pass |
| Mack cyclic bench | Pass | Pass |
| SSP-180 synchronization endurance cyclic bench | Pass | Pass |

It was indicated from laboratory results that, the lubricant composition (XII) passed the CRC L-42, L-37, L-33, L-60, L-60-1 full size gear bench test, the manual gear box MACK cyclic bench test for truck and autobus, and the manual gear box SSP-180 synchronization endurance cyclic bench test for car, fully meeting the US force standard MIL-PRF-2105E, while enabling lubrication in the manual gear box and live axle of vehicle, leading to generalization of the oils for the vehicle transmission system.

What is claimed is:

1. A lubricant composition for a full transmission system, comprising:

(A) at least an ashless dispersant of 0.5-5.0 wt % based on the composition, being mono(polyisobutenyl) succinimide, or bis(polyisobutenyl) succinimide, or multi (polyisobutenyl) succinimide, boronated mono(polyisobutenyl) succinimide, or boronated bis (polyisobutenyl) succinimide, or boronated multi (polyisobutenyl) succinimide, or borophosphorated mono(polyisobutenyl) succinimide, or borophosphorated bis(polyisobutenyl) succinimide, or borophosphorated multi(polyisobutenyl) succinimide, or mixture from any combination thereof;

(B) at least a friction modifier of 0.1-2.0 wt % based on the composition, being long-chain phosphate, or long-chain phosphite, or long-chain phosphonate, or long-chain fatty acid ester, or long-chain boronated fatty acid ester, or long-chain phosphate amine salt, or long-chain phosphite amine salt, or long-chain phosphonate amine salt, or mixture from any combination thereof;

(C) at least a phosphorus-containing antiwear additive of 0.1-2.0 wt % based on the composition, being the mixture of thiophosphoric acid fatty amine formaldehyde condensate, thiophosphoric acid benzotriazole formal dehyde condensate, and thiophosphate and amine salt thereof;

(D) at least an antirust additive of 0.01-1.0 wt. % based on the composition, being calcium alkylbenzene sulfonate, or alkyl calcium alkylbenzene sulfonate, or sulfurized alkyl phenate, or mixture from any combination thereof;

(E) at least a sulfur-containing extreme-pressure additive of 3.0-6.0 wt % based on the composition, being sulfurized olefin, or sulfurized polyolefin, or alkyl polysulfide, or mixture from any combination thereof;

(F) at least a metal deactivation additive of 0.01-1.0 wt % based on the composition, being thiadiazole disulfide, or alkylated thiadiazole dimer, or thiadiazole fatty amine formaldehyde condensate, or adduct of thiadiazole and long-chain olefin, or mixture from any combination thereof;

(G) at least a viscosity index improver of 0.1-25 wt % based on the composition, being polymethacrylate, or polyisobutylene with a molecular weight of 800-2000, or mixture from any combination thereof;

(H) at least a pour-point depressant of 0.1-2.0 wt % based on the composition, being polymethacrylate, or poly(α-olefin), or mixture from any combination thereof; and (I) at least a highly refined mineral oil with high viscosity index, or polyolefin synthetic oil, or ester synthetic oil, or mixture from any combination thereof, of 56.00-96.08 wt % based on the composition.

2. The lubricant composition for the full transmission system according to claim 1, wherein the polyisobutylene of compound in the component (A) has a molecular weight of 500-5000, with a content of 1.0-5.0 wt %.

3. The lubricant composition for the full transmission system according to claim 1, wherein the component (B) is dodecyl phosphate, or octadecyl phosphate, or dodecyl phosphite, or octadecyl phosphite, or dodecyl phosphonate, or octadecyl phosphonate, or ethylene glycol oleate, or glycerol oleate, or boronated ethylene glycol oleate, or boronated glycerol oleate, or phosphate laurylamine salt, or phosphate stearylamine salt, or phosphite laurylamine salt, or phosphite octadecylamine salt, or phosphonate laurylamine salt, or phosphonate octadecylamine salt, or mixture from any combination thereof, with a content of 0.3-2.0 wt %.

4. The lubricant composition for the full transmission system according to claim 1, wherein the component (C) is the mixture of di-n-butyl thiophosphoric acid fatty amine formaldehyde condensate, di-n-butyl thiophosphoric acid benzotriazole formaldehyde condensate, and di-n-butyl thiophosphate fatty amine salt, with a content of 0.3-2.0 wt %.

5. The lubricant composition for the full transmission system according to claim 1, wherein the component (D) is calcium alkylbenzene sulfonate with high base number, or calcium alkylbenzene sulfonate with low base number, or calcium sulfurized alkyl phenate with high base number, or calcium sulfurized alkyl phenate with low base number, or mixture from any combination thereof, with a content of 0.02-1.0 wt %.

6. The lubricant composition for the full transmission system according to claim 1, wherein the component (E) is multi-sulfurized polyisobutylene, or multi-sulfurized isobutylene, or tert-butyl polysulfide, or mixture from any combination thereof, with a content of 3.0-5.0 wt %.

7. The lubricant composition for the full transmission system according to claim 1, wherein the component (F) is thiadiazole dodecyl disulfide, or thiadiazole octadecyl disulfide, or dodecyl thiadiazole dimer, or octadecyl thiadiazole dimer, or thiadiazole laurylamine formaldehyde condensate, or thiadiazole stearylamine formaldehyde condensate, or adduct of thiadiazole and dodecylene, or adduct of thiadiazole and octadecene, or mixture from any combination thereof, with a content of 0.05-1.0 wt %.

8. The lubricant composition for the full transmission system according to claim 1, wherein the component (G) is polymethacrylate with a molecular weight of 500-5000, or polyisobutylene with a molecular weight of 800-2000, or mixture from any combination thereof, with a content of 0.1-20 wt %.

9. The lubricant composition for the full transmission system according to claim 1, wherein the component (H) has a content of 0.3-2.0 wt %.

10. The lubricant composition for the full transmission system according to claim 1, wherein the component (I) is an isomerized, dewaxed and hydrogenated base oil, or poly(α-olefin) synthetic oil, or di-ester synthetic oil, or polyol ester synthetic oil, or mixture from any combination thereof, with a content of 62.00-94.93 wt %.

* * * * *